US008849135B2

(12) United States Patent
Zaretsky et al.

(10) Patent No.: US 8,849,135 B2
(45) Date of Patent: Sep. 30, 2014

(54) PRODUCING RAISED PRINT USING THREE TONERS

(71) Applicants: Mark Cameron Zaretsky, Rochester, NY (US); Donald Saul Rimai, Webster, NY (US); Dinesh Tyagi, Fairport, NY (US)

(72) Inventors: Mark Cameron Zaretsky, Rochester, NY (US); Donald Saul Rimai, Webster, NY (US); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 163 days.

(21) Appl. No.: 13/663,564

(22) Filed: Oct. 30, 2012

(65) Prior Publication Data

US 2014/0119753 A1 May 1, 2014

(51) Int. Cl.
*G03G 15/01* (2006.01)

(52) U.S. Cl.
USPC ..... 399/40

(58) Field of Classification Search
CPC ..... G03G 15/131; G03G 15/178
USPC ..... 399/40
See application file for complete search history.

(56) References Cited

U.S. PATENT DOCUMENTS

| | | | | |
|---|---|---|---|---|
| 5,859,920 | A | 1/1999 | Daly et al. | |
| 7,831,178 | B2 | 11/2010 | Priebe et al. | |
| 8,064,788 | B2 | 11/2011 | Zaretsky et al. | |
| 2003/0096073 | A1 * | 5/2003 | Cser et al. | 428/40.1 |
| 2008/0159786 | A1 | 7/2008 | Tombs et al. | |
| 2011/0193336 | A1 | 8/2011 | Eschbach et al. | |
| 2011/0200932 | A1 | 8/2011 | Tyagi et al. | |
| 2012/0099879 | A1 | 4/2012 | Aslam et al. | |

* cited by examiner

*Primary Examiner* — Walter L Lindsay, Jr.
*Assistant Examiner* — Frederick Wenderoth
(74) *Attorney, Agent, or Firm* — Christopher J. White

(57) ABSTRACT

A method for producing a raised print using a three-component printer includes receiving image data and height data for an image to be printed, the height data specifying that raised printing should be produced in a non-yellow region of the image data. Separation data are determined for a yellow toner and two additional colored toners. The yellow separation data is determined based on the image data and the height data. The yellow separation and at least one of the colored separations specify that respective toners be deposited one atop the other in the non-yellow region. The two additional colored toners include respective amounts of black colorant. Using the printer with exactly three printing modules, respective toner images are deposited on the receiver, each corresponding to respective separation data. The deposited toner is fixed to the receiver.

10 Claims, 4 Drawing Sheets

PRODUCING RAISED PRINT USING THREE TONERS

CROSS-REFERENCE TO RELATED APPLICATIONS

This application is co-filed with and has related subject matter to U.S. patent application Ser. No. 13/663,532, titled "PRODUCING RAISED PRINT USING YELLOW TONER;" and U.S. patent application Ser. No. 13/663,548, titled "PRODUCING RAISED PRINT USING LIGHT TONER;" each filed Oct. 30, 2012, each by Marc C. Zaretsky et al. and each of which is incorporated herein by reference.

This application has related subject matter to U.S. patent application Ser. No. 13/537,165, filed Jun. 29, 2012, by Mark C. Zaretsky, titled "MAKING ARTICLE WITH DESIRED PROFILE."

FIELD OF THE INVENTION

This invention pertains to the field of printing and more particularly to producing prints having heights matching a desired profile.

BACKGROUND OF THE INVENTION

Printers are useful for producing printed images of a wide range of types. Printers print on receivers (or "imaging substrates"), such as pieces or sheets of paper or other planar media, glass, fabric, metal, or other objects. Printers typically operate using subtractive color: a substantially reflective receiver is overcoated image-wise with cyan (C), magenta (M), yellow (Y), black (K), and other colorants. Various schemes can be used to process images to be printed.

For example, commonly-assigned U.S. Publication No. 2008/0159786 by Tombs et al., entitled "SELECTIVE PRINTING OF RAISED INFORMATION BY ELECTROGRAPHY," published Jul. 3, 2008, the disclosure of which is incorporated herein by reference, describes electrophotographic printing using marking particles of a substantially larger size than the standard size marking particles of the desired print image. Tombs et al. also describe using non-pigmented ("clear") marking particles to overlay raised printing on an image. Using clear toners can improve image quality by reducing image relief artifacts with an inverse mask and providing a desired surface gloss. There is still, though, a continuing need for providing higher raised printing (e.g., thicker marking-particle stacks). Reference is also made to commonly-assigned U.S. Pat. No. 8,064,788 to Zaretsky et al., incorporated herein by reference.

Various schemes print patterns of yellow colorant as security features.

SUMMARY OF THE INVENTION

Moreover, there is also a need for ways of printing raised printing in a printer using three channels (conventionally, CMY) instead of five channels (e.g., CMYK+Clear).

Commonly-assigned U.S. Pat. No. 5,859,920 to Daly et al., incorporated herein by reference, describes that the human eye has weak blue-yellow sensitivity. This reference describes useful techniques for embedding digital data in a source image. There is still a need for printing raised printing.

As used herein, "raised printing" refers to toner marking particles extending a desired height above the surface of the receiver on which they are printed. The desired height in a selected region of the receiver is specified as part of the print job, as is any visible image content to be printed as part of the print job. In various aspects, raised printing includes toner marking particles extending farther above the surface of the receiver than do toner marking particles not part of raised printing.

According to an aspect of the present invention, there is provided a method for producing a raised print on a receiver using an electrophotographic printer including exactly three printing modules, the method comprising:

receiving image data and height data for an image to be printed, the image data including a non-yellow region and the height data specifying that raised printing should be produced in the non-yellow region;

using a processor, automatically determining separation data for a yellow toner and two additional colored toners, wherein the separation data for the yellow toner is determined in response to the image data and the height data so that the yellow separation and at least one of the two additional colored separations specify that respective toners be deposited one atop the other in the non-yellow region, wherein the yellow toner has a volume-weighted median diameter ranging between 12 and 20 μm and the two additional colored toners have respective volume-weighted median diameters between 3 μm and 12 μm, and the two additional colored toners include respective amounts of black colorant;

using the electrophotographic printer including the exactly three printing modules, depositing respective developed toner images on the receiver using the respective printing modules, each respective printing module and each respective developed toner image corresponding to respective separation data; and fixing the deposited toner images to the receiver using a fixing device.

An advantage of the present invention is that it prints raised printing in printers with three color channels. Various aspects permit balancing requirements for higher-gamut image content with requirements for higher raised printing, depending on the requirements of a particular print job.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
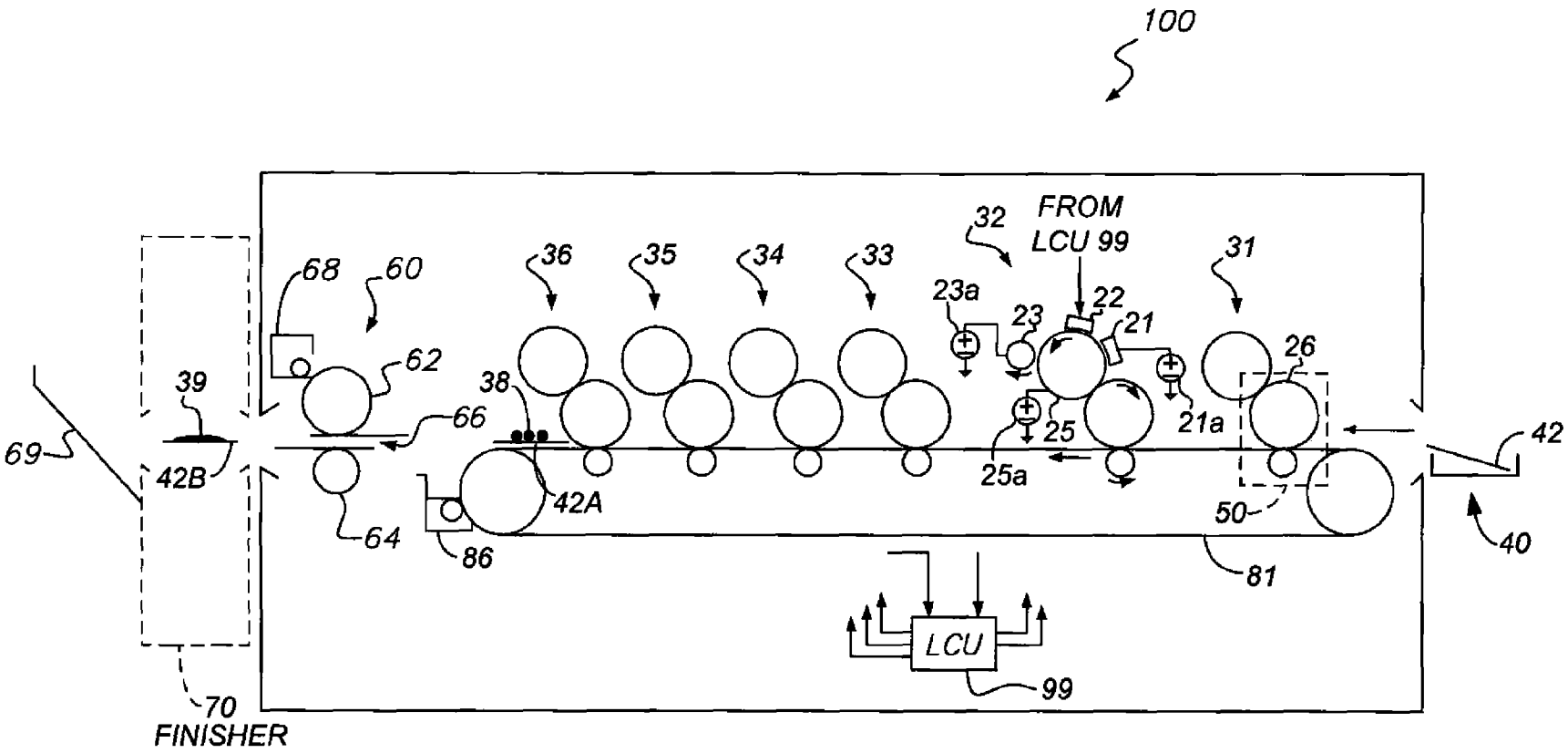
FIG. 1 is an elevational cross-section of an electrophotographic reproduction apparatus.

The attached drawings are for purposes of illustration and are not necessarily to scale.

DETAILED DESCRIPTION OF THE INVENTION

In the following description, some aspects will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, methods described herein. Other aspects of such algorithms and systems, and hardware or software for producing and otherwise processing the image signals involved therewith, not specifically shown or described herein, are selected from such systems, algorithms, components, and elements known in the art. Given the system as described herein, software not specifically shown, suggested, or described herein that is useful for implementation of various aspects is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods according to various aspects.

The electrophotographic (EP) printing process can be embodied in devices including printers, copiers, scanners, and facsimiles, and analog or digital devices, all of which are referred to herein as "printers." Electrostatographic printers such as electrophotographic printers that employ toner developed on an electrophotographic receiver can be used, as can ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some aspects, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an aspect of an electrophotographic modular printing machine, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and light black (Lk), but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

FIG. 1 is an elevational cross-section showing portions of a typical electrophotographic printer 100. Printer 100 is adapted to produce print images, such as single-color (monochrome), CMYK, or hexachrome (six-color) images, on a receiver (multicolor images are also known as "multi-component" images). Images can include text, graphics, photos, and other types of visual content. An aspect involves printing using an electrophotographic print engine having six sets of single-color image-producing or -printing stations or modules arranged in tandem, but more or fewer than six colors can be combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, 36, also known as electrophotographic imaging subsystems. Each printing module 31, 32, 33, 34, 35, 36 produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various aspects, the visible image can be transferred directly from an imaging roller to a receiver 42, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and toning station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning station 23 and are attracted to the latent image to develop the latent image into a visible image. Note that the visible image may not be visible to the naked eye depending on the composition of the toner particles (e.g. clear toner). Toning station 23 can also be referred to as a development station. Toner can be applied to either the charged or discharged parts of the latent image.

After the latent image is developed into a visible image on photoreceptor 25, a suitable receiver 42 is brought into juxtaposition with the visible image. Receiver 42 can be juxtaposed with photoreceptor 25. The visible image can also be transferred to intermediate member 26 (e.g., using electrostatic and contact forces) and thence to receiver 42. Intermediate member 26 can be a rotatable member, e.g., a drum or belt. In transfer subsystem 50, a suitable electric field is applied to transfer the toner particles of the visible image from intermediate member 26 to receiver 42 to form the desired print image 38 on the receiver, as shown on receiver 42A. The imaging process is typically repeated many times with reusable photoreceptors 25.

Receiver 42A is then removed from its operative association with photoreceptor 25 and subjected to heat or pressure to permanently fix ("fuse") print image 38 to receiver 42A. Plural print images, e.g. of separations of different colors, are overlaid on one receiver before fusing to form a multi-color print image 38 on receiver 42A.

Each receiver 42, during a single pass through the six printing modules 31, 32, 33, 34, 35, 36, can have transferred in registration thereto up to six single-color toner images to form a pentachrome image. As used herein, the term "hexachrome" implies that in a print image, combinations of various of the six colors are combined to form other colors on receiver 42 at various locations on receiver 42. That is, each of the six colors of toner can be combined with toner of one or more of the other colors at a particular location on receiver 42 to form a color different than the colors of the toners combined at that location. In an aspect, printing module 31 forms black (K) print images, 32 forms yellow (Y) print images, 33 forms magenta (M) print images, 34 forms cyan (C) print images, 35 forms light-black (Lk) images, and 36 forms clear images.

In various aspects, printing module 36 forms print image 38 using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 36. Print image 38 on receiver 42A includes unfused toner particles.

Subsequent to transfer of the respective print images 38, overlaid in registration, one from each of the respective printing modules 31, 32, 33, 34, 35, 36, receiver 42A is advanced to a fuser 60, i.e. a fusing or fixing assembly, to fuse print image 38 to receiver 42A. Transport web 81 transports the print-image-carrying receivers (e.g., 42A) to fuser 60, which fixes the toner particles to the respective receivers 42A by the application of heat and pressure. The receivers 42A are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an aspect, fuser 60 also includes a release fluid application substation 68 that applies release fluid, e.g. silicone oil, to fusing roller 62. Alternatively, wax-containing toner can be used without applying release fluid to fusing roller 62. Other aspects of fusers, both contact and non-contact, can be employed. For example, solvent fixing uses solvents to soften the toner particles so they bond with the receiver 42. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42.

The receivers (e.g., receiver 42B) carrying the fused image (e.g., fused image 39) are transported in a series from the fuser 60 along a path either to a remote output tray 69, or back to printing modules 31, 32, 33, 34, 35, 36 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fusers 60 to support applications such as overprinting, as known in the art.

In various aspects, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an aspect, charger 21 is a corona charger including a grid between the corona wires (not shown) and photoreceptor 25. Voltage source 21*a* applies a voltage to the grid to control charging of photoreceptor 25. In an aspect, a voltage bias is applied to toning station 23 by voltage source 23*a* to control the electric field, and thus the rate of toner transfer, from toning station 23 to photoreceptor 25. In an aspect, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an aspect, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference. Other configurations of printer can be used, e.g., configurations in which more than one toning station 23 is arranged adjacent to photoreceptor 25, and the print image is produced by depositing multiple visible images in register on the photoreceptor and then transferring them together (e.g., via intermediate member 26) to receiver 42, or by moving receiver 42 past photoreceptor 25 or intermediate member 26 multiple times, one for each color separation.

Figure 2:
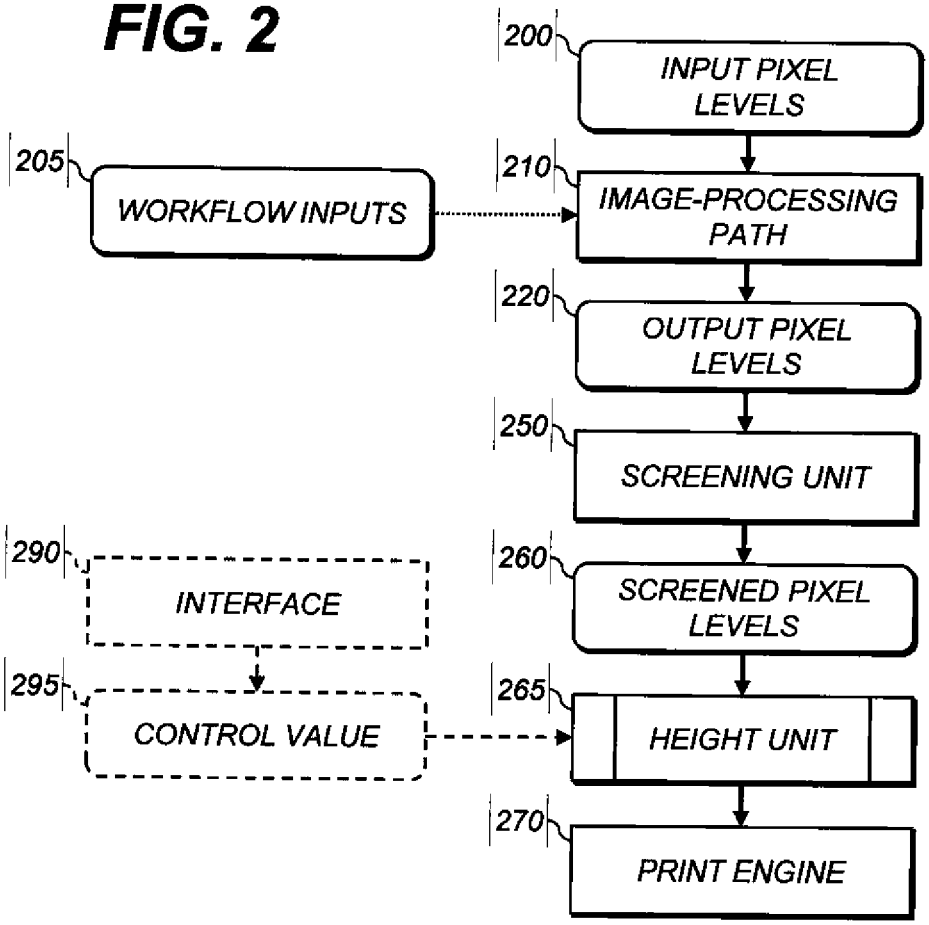
FIG. 2 shows a data-processing path.

FIG. 2 shows a data-processing path, and defines several terms used herein. Printer 100 (FIG. 1) or corresponding electronics (e.g. the DFE or RIP), described herein, operate this data path to produce image data corresponding to exposure to be applied to a photoreceptor, as described above. The datapath can be partitioned in various ways between the DFE and the print engine, as is known in the image-processing art.

The following discussion relates to a single pixel; in operation, data processing takes place for a plurality of pixels that together compose an image. The term "resolution" herein refers to spatial resolution, e.g. in cycles per inch. The term "bit depth" refers to the range and precision of values. Each set of pixel levels has a corresponding set of pixel locations. Each pixel location is the set of coordinates on the surface of receiver 42 (FIG. 1) at which an amount of toner corresponding to the respective pixel level should be applied.

Printer 100 receives input pixel levels 200. These can be any level known in the art, e.g. sRGB code values (0 . . . 255) for red, green, and blue (R, G, B) color channels. There is one pixel level for each color channel. Input pixel levels 200 can be in an additive or subtractive space. Image-processing path 210 converts input pixel levels 200 to output pixel levels 220, which can be cyan, magenta, yellow (CMY); cyan, magenta, yellow, black (CMYK); or values in another subtractive color space. This conversion can be part of the color-management system discussed above. Output pixel level 220 can be linear or non-linear with respect to exposure, L*, or other factors known in the art.

Image-processing path 210 transforms input pixel levels 200 of input color channels (e.g. R) in an input color space (e.g. sRGB) to output pixel levels 220 of output color channels (e.g. C) in an output color space (e.g. CMYK). In various aspects, image-processing path 210 transforms input pixel levels 200 to desired CIELAB (CIE 1976 L*a*b*; CIE Pub. 15:2004, 3rd. ed., §8.2.1) values or ICC PCS (Profile Connection Space) LAB values, and thence optionally to values representing the desired color in a wide-gamut encoding such as ROMM RGB. The CIELAB, PCS LAB or ROMM RGB values are then transformed to device-dependent CMYK values to maintain the desired colorimetry of the pixels. Image-processing path 210 can use optional workflow inputs 205, e.g. ICC profiles of the image and the printer 100, to calculate the output pixel levels 220. RGB can be converted to CMYK according to the Specifications for Web Offset Publications (SWOP; ANSI CGATS TR001 and CGATS.6), Euroscale (ISO 2846-1:2006 and ISO 12647), or other CMYK standards. Part of an aspect of image-processing path 210 is shown in FIG. 2, discussed below. Image-processing path 210, or screening unit 250, can perform image processing processes including layer corrections, in order to obtain a desired final 3D shape on the final print.

Input pixels are associated with an input resolution in pixels per inch (ippi, input pixels per inch), and output pixels with an output resolution (oppi). Image-processing path 210 scales or crops the image, e.g. using bicubic interpolation, to change resolutions when ippi≠oppi. The following steps in the path (output pixel levels 220, screened pixel levels 260) are preferably also performed at oppi, but each can be a different resolution, with suitable scaling or cropping operations between them.

Screening unit 250 calculates screened pixel levels 260 from output pixel levels 220. Screening unit 250 can perform continuous-tone (processing), halftone, multitone, or multilevel halftone processing, and can include a screening memory or dither bitmaps. Screened pixel levels 260 are provided to height unit 265.

In various aspects, height unit 265 receives control value 295 via interface 290. This is discussed below.

Height unit 265 adjusts screened pixel levels 260, if adjustment is needed, to provide images with desired fused toner stack heights. The outputs of height unit 265 are separation data values at the bit depth required by print engine 270, to which those values are provided. Further details of height unit 265 are given in FIG. 4.

Print engine 270 represents the subsystems in printer 100 that apply an amount of toner corresponding to the separation data from height unit 265 to receiver 42 (FIG. 1) at respective screened pixel locations. Examples of these subsystems are described above with reference to FIG. 1. The screened pixel levels and locations can be the engine pixel levels and locations, or additional processing can be performed to transform the screened pixel levels and locations into the engine pixel levels and locations.

Figure 3:
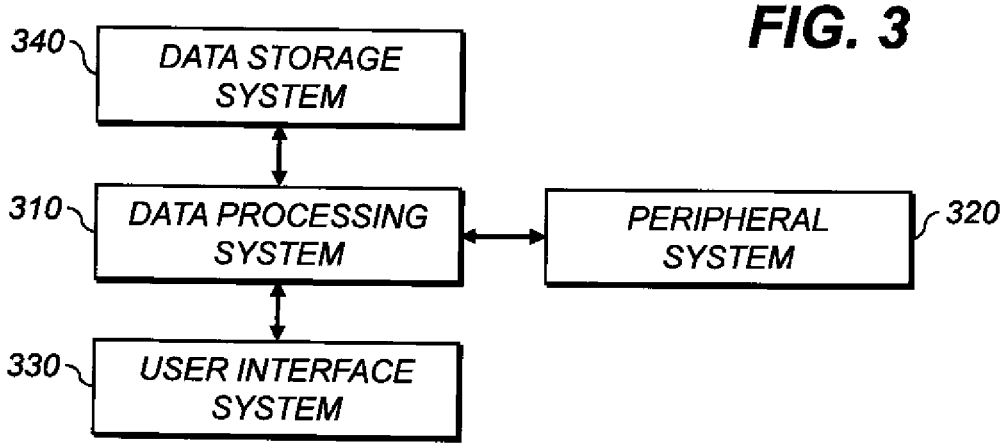
FIG. 3 is a high-level diagram showing the components of a processing system useful with various aspects.

FIG. 3 is a high-level diagram showing the components of a processing system useful with various aspects. The system includes a data processing system 310, a peripheral system 320, a user interface system 330, and a data storage system 340. Peripheral system 320, user interface system 330 and data storage system 340 are communicatively connected to data processing system 310.

Data processing system 310 includes one or more data processing devices that implement the processes of various aspects, including the example processes described herein. The phrases "data processing device" or "data processor" are intended to include any data processing device, such as a central processing unit ("CPU"), a desktop computer, a laptop computer, a mainframe computer, a personal digital assistant, a Blackberry™, a digital camera, cellular phone, or any other device for processing data, managing data, or handling data, whether implemented with electrical, magnetic, optical, biological components, or otherwise.

Data storage system 340 includes one or more processor-accessible memories configured to store information, including the information needed to execute the processes of the various aspects, including the example processes described herein. Data storage system 340 can be a distributed processor-accessible memory system including multiple processor-accessible memories communicatively connected to data processing system 310 via a plurality of computers or devices. On the other hand, data storage system 340 need not be a distributed processor-accessible memory system and, consequently, can include one or more processor-accessible memories located within a single data processor or device.

The phrase "processor-accessible memory" is intended to include any processor-accessible data storage device, whether volatile or nonvolatile, electronic, magnetic, optical, or otherwise, including but not limited to, registers, floppy disks, hard disks, Compact Discs, DVDs, flash memories, ROMs, and RAMs.

The phrase "communicatively connected" is intended to include any type of connection, whether wired or wireless, between devices, data processors, or programs in which data can be communicated. The phrase "communicatively connected" is intended to include a connection between devices or programs within a single data processor, a connection between devices or programs located in different data processors, and a connection between devices not located in data processors at all. In this regard, although the data storage system 340 is shown separately from data processing system 310, one skilled in the art will appreciate that data storage system 340 can be stored completely or partially within data processing system 310. Further in this regard, although peripheral system 320 and user interface system 330 are shown separately from data processing system 310, one skilled in the art will appreciate that one or both of such systems can be stored completely or partially within data processing system 310.

Peripheral system 320 can include one or more devices configured to provide digital content records to data processing system 310. For example, peripheral system 320 can include digital still cameras, digital video cameras, cellular phones, or other data processors. Data processing system 310, upon receipt of digital content records from a device in peripheral system 320, can store such digital content records in data storage system 340. Peripheral system 320 can also include a printer interface for causing a printer to produce output corresponding to digital content records stored in data storage system 340 or produced by data processing system 310.

User interface system 330 can include a mouse, a keyboard, another computer, or any device or combination of devices from which data is input to data processing system 310. In this regard, although peripheral system 320 is shown separately from user interface system 330, peripheral system 320 can be included as part of user interface system 330.

User interface system 330 also can include a display device, a processor-accessible memory, or any device or combination of devices to which data is output by data processing system 310. In this regard, if user interface system 330 includes a processor-accessible memory, such memory can be part of data storage system 340 even though user interface system 330 and data storage system 340 are shown separately in FIG. 1.

Structures can be printed using electrophotography. Multiple layers of predetermined size marking particles can be deposited in register on each other to create a final pre-fixing three-dimensional (3D) shape. This final pre-fixing shape is optionally fixed with heat, pressure, or chemicals to yield a desired predetermined post-fixing three-dimensional shape. The height of each toner layer is determined algorithmically. After each layer is laid down, the height of the layer is measured and the remaining heights recalculated based on the desired shape. A determination is made as to whether a height correction should be made to the remaining layers as they are laid down or if alternate layers should be applied in conjunction with alternate fixing methods, such as a reducing heat fixing step. The heights of layers can also be characterized before the structure is printed, and each layer assumed to contribute its characterized height.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

In various aspects, the toner used to form the final predetermined shape is a styrenic-type (styrene butyl acrylate) or a polyester-type toner binder. Other similar materials can also be used. These can include both thermoplastics, such as the polyester types and the styrene acrylate types as well as PVC and polycarbonates, especially in high temperature applications such as projection assemblies. One example is an Eastman Chemical polyester-based resin sheet, LENSTAR, specifically designed for the lenticular market. Also thermosetting plastics can be used, such as the thermosetting polyester beads prepared in a PVA1 stabilized suspension polymerization system from a commercial unsaturated polyester resin at the Israel Institute of Technology.

The toner used to form the final predetermined shape is affected by the size distribution so a closely controlled size and shape is desirable. This can be achieved through the grinding and treating of toner particles to produce various resultant sizes. This is difficult to do for the smaller particular sizes and tighter size distributions since there are a number of fines produced that should be separated out. This results in either undesirable distribution or a very expensive and poorly controlled development process. An alternative is to use a limited-coalescence or evaporative limited-coalescence technique that can control the size using stabilizing particles, such as silicon. Toner particles prepared in these ways are referred to herein as "chemically-prepared dry ink" (CDI). Some of these limited-coalescence techniques are described in patents pertaining to the preparation of electrostatic toner particles because such techniques typically result in the formation of toner particles having a substantially uniform size and uniform size distribution. Representative limited-coalescence processes employed in toner preparation are described in U.S. Pat. Nos. 4,833,060 and 4,965,131, both incorporated herein by reference.

In the limited-coalescence techniques described, toner additives, such as charge control agents and pigments, are selected to control the surface roughness of toner particles by taking advantage of the aqueous organic inter-phase present. Toner additives employed for this purpose can be highly surface active or hydrophilic in nature; in that case, such additives can also be present at the surface of the toner particles. Particulate and environmental factors related to toner formation include the toner particle charge/mass ratio (it should not be too low), surface roughness, thermal transfer, electrostatic transfer, pigment coverage, and environmental effects such as temperature, humidity, chemicals, and radiation, whether affecting the toner or the receiver.

In these aspects, toner has a tensile modulus ($10^3$ psi) of 150-500, normally 345, a flexural modulus ($10^3$ psi) of 300-500, normally 340, a hardness of M70-M72 (Rockwell), a thermal expansion of 68-70 $10^{-6}$/degree Celsius, a specific gravity of 1.2 and a slow, slight yellowing under exposure to light (according to J. H. DuBois and F. W. John, eds., in Plastics, $5^{th}$ edition, Van Norstrand and Reinhold, 1974; page 522).

In contact fixing, the speed of fixing and resident times and related pressures applied are selected to achieve the particular final desired shape. Contact fixing can fix more quickly than non-contact fixing. Fixing can be performed by contact with hot rollers, as described above, or without contact, e.g., by applying heat, chemicals, IR, or UV to the unfixed toner. The described toner can have a melting point that is between 50-300 degrees Celsius. Surface tension, roughness and viscosity of the toner are selected to yield a spherical, not circular, shape; this can improve transfer. Surface profiles and roughness can be measured using the FEDERAL SURFANALYZER 5000 or similar devices. Moreover, larger toner particles can have fewer air inclusions than smaller toner particles, increasing transparency of toner particles. Color density can be measured under the standard CIE test by Gretag-Macbeth in a colorimeter and is expressed in L*a*b* units. Toner viscosity can be measured by a Mooney viscometer. Higher viscosities can keep a shape better and can result in greater height. Higher viscosity toners can also retain their form over a longer period of time.

In these aspects, toners can have a glass transition temperature ($T_g$) between 50-100 degrees Celsius, e.g., approximately 60 degrees Celsius. Permanence of the color and clear under UV and IR exposure can be determined as a loss of clarity over time. The lower the loss, the better the result. Clarity, or low haze, is desirable for optical elements that are transmissive or reflective wherein clarity is an indicator and haze is a measure of higher percent of transmitted light.

The unfused toner stack height capability ($SU_i$) for marking particles with a certain volume-weighted median diameter in deposition station i (i.e., before fixing) is a function of parameters of the specific marking particles (e.g., diameter, charge-to-mass, packing fraction, shape and size distribution, density, clarity, or refractive index) and parameters of deposition station i with which those marking particles are deposited on the receiver (e.g., toning potential, the potential driving the particle to an imaging or image receiving member; toning field; toning roller rotational speed; toner-photoreceptor spacing; and toner concentration, in a two-component developer mix). A minimum and maximum unfused toner stack height ($SUmin_i$ and $SUmax_i$) can be defined for each station i (with a particular size toner): $SUmin_i$ equals the particular volume-weighted median diameter in deposition station i and $SUmax_i$ is determined electrostatically by the space charge limit in the development zone of deposition station i. Typically $$2SU\min_i \leq SU\max_i \leq 3SU\min_i$$

and $SUmax_i$ is highly dependent upon the charge-to-mass of the marking particle. The maximum unfused stack height varies inversely with charge-to-mass; however dusting and contamination will also vary inversely with charge-to-mass.

The fused toner stack height ($SF_i$) for a given unfused stack height ($SU_i$) produced by each deposition station i when using a particular fixing method depends on parameters of the specific marking particle (e.g., viscoelastic response, volume-weighted median diameter, shape and size distribution, surface addenda, melting point, or surface tension) or on parameters of the particular fixing method (e.g., fuser roller surface temperature for a nipped heated rollers; residence time in fuser; pressure; roller surface finish; or thermal conductivity). Note that, depending upon the particular fixing method chosen, $SF_i$ can be controllable on a pixel basis, as for example, as in a laser sintering operation.

A minimum and maximum fused toner stack height ($SFmin_i$ and $SFmax_i$) can be defined for each deposition station i and correspond to the effect of passing the minimum and maximum unfused toner stack heights ($SUmin_i$ and $SUmax_i$) through the fixing station.

Table 1 shows simulated examples for four different sizes of toner. Each deposition station can provide a minimum and maximum unfused stack height ranging from the toner diameter to 2.5× toner diameter. The fixing method results in a fused toner stack height that is roughly one-half of the unfused toner stack height.

TABLE 1

| | Volume-Weighted Median Diameter (μm) | | | |
|---|---|---|---|---|
| | 3 | 8 | 20 | 50 |
| Minimum Unfused Stack Height (μm) | 3 | 8 | 20 | 50 |
| Maximum Unfused Stack Height (μm) | 7.5 | 20 | 50 | 125 |
| Minimum Fused Stack Height (μm) | 1.5 | 4 | 10 | 25 |
| Maximum Fused Stack Height (μm) | 3.75 | 10 | 25 | 62.5 |

Each toner has a selected covering power based on a toner size and intended application. Covering power is the area covered to a transmission density of 1.0 by one gram of toner, in $cm^2/g$. This is the inverse of the toner mass laydown per unit area that provides a transmission density of 1.0, as described in U.S. Pat. No. 6,432,598, incorporated herein by reference, particularly on col. 4, lines 13-26. At this density, the toner layer is typically at least a monolayer so that it completely covers a selected portion of the substrate. One factor in varying covering power is the pigment loading used in the toner formulation (mass percent pigment in a toner formulation). Given two toners of different sizes, one toner having particles half the size of the other, the smaller-particle toner will need to have a higher pigment loading and higher covering power in order to achieve the same desired reflection density as the larger-particle toner at a roughly monolayer coverage for each toner (given that other factors are equal, e.g., uniformity of pigment dispersion within the toner formulation). In an example, 8 μm-diameter color toner particles have a covering power of approximately 1600 $cm^2/g$. The product of the toner particle diameter (expressed in cm) and the covering power (in $cm^2/g$) is 1.28 $cm^3/g$. In various aspects, a toner set is used in which the yellow toner has approximately ¼ to ⅓ the pigment loading of cyan or magenta toners. In various aspects, the covering power of yellow is to the covering power of cyan (or magenta) as the size of cyan (or magenta) is to the size of yellow, or less. In an example, the covering power of the yellow toner is less than 1.28 $cm^3/g$ divided by the average diameter of the yellow toner particles.

Figure 4:
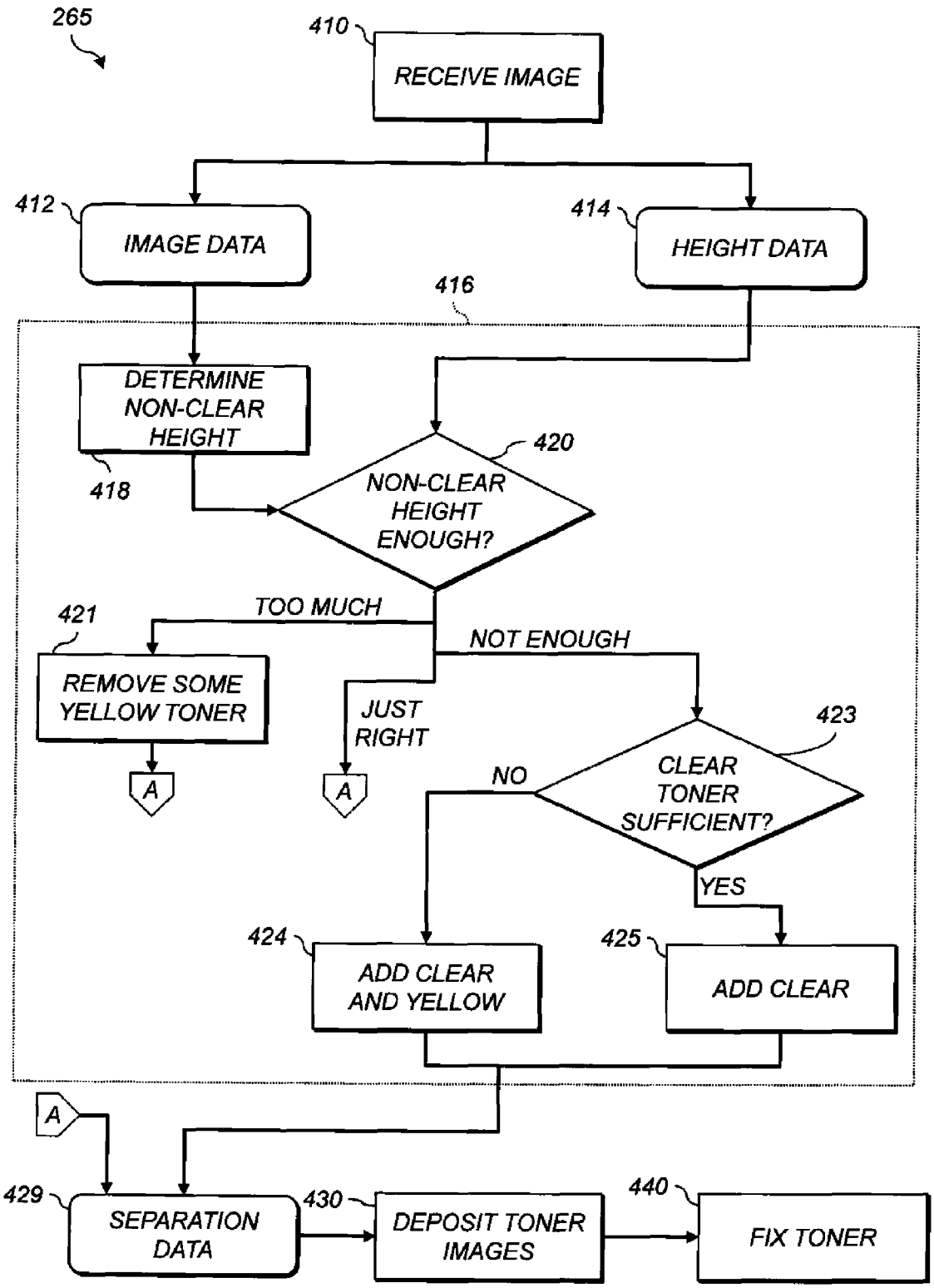
FIGS. 4 and 5 show methods for producing raised prints on a receiver according to various aspects.

FIG. 4 shows methods for producing raised prints on a receiver. These methods can be implemented in a processor, e.g., height unit 265 (FIG. 2). These methods use yellow toner in addition to clear toner to provide desired stack heights. Since the human eye is generally less sensitive to yellow than to cyan, magenta, or black, yellow toner is used to add height without objectionably changing the color of engine pixels over which yellow toner is deposited. The image will be printed using a yellow (Y) toner, a clear (T for "transparent," although absolute transparency is not required) toner, and toners of at least two additional colored toners (A, B), as discussed below with respect to step 430. Processing begins with step 410.

In step 410, image data and height data for an image to be printed are received. The image data specifies the color of each input pixel. In various aspects, image data 412 include screened pixel levels 260 (FIG. 2), as discussed above. Each engine pixel has an area on the receiver, e.g., $(1/600")^2$ for a 600×600 dpi printer. The image data specifies respective non-negative mass laydowns of toner of each color (e.g., yellow, first additional, or second additional) to be deposited at each engine pixel location. Mass laydown is mass of toner per unit area. It can be calculated as the mass of toner deposited at a particular engine pixel location divided by the area of that engine pixel. In various aspects, image data 412 specifies percentage coverage (0-100%) of a maximum-density ($D_{max}$) patch for the given color, and the printer stores a non-linear relationship between percent coverage and mass laydown.

A relationship, linear or non-linear, can be determined between mass laydown of each toner and the fused toner stack height of that toner. This relationship can be stored in a nonvolatile memory in the printer. For example, when using a 21 μm toner, 100% coverage corresponds to 2.0 $mg^2/cm$ and a fused toner stack height of 18 μm, and 50% coverage corresponds to 0.7 $mg^2/cm$ and a fused toner stack height of 8 μm.

As used herein, mass laydowns (in $mg/cm^2$ unless otherwise specified) are denoted "$M_x$" for some color or condition x, and fused toner stack heights are denoted "$H_x$" for some color or condition x. The relationship mapping mass laydown to fused toner stack height is "$M2H_x(m)$" for some mass laydown m, and the inverse relationship is $H2M_x(h)$ for some height h, both for some color or condition x. $M_x$ and $H_x$ values are per-engine-pixel, but for clarity, (i,j) subscripts denoting the row and column of the engine pixel are omitted.

Height data 414 (herein $H_{aim}$) specifies desired fused toner stack heights for various regions of the image. Height data can include a stack-height specification per engine pixel location, a single stack-height specification for the entire image, or respective stack-height specifications for regions of the image, each region including one or more engine pixels. The image data can be mapped to fused toner stack heights, as described above. The fused toner stack heights of each toner deposited at a given engine pixel location can be summed to determine an image-data stack height at that engine pixel location.

In various aspects, yellow toner is used to increase the stack heights of engine pixels in an area of the image that does not contain significant yellow content. The heights are increased above the image-data stack height. Specifically, the image data includes a non-yellow region. The height data specifies that raised printing should be produced in the non-yellow region.

A non-yellow region is defined with respect to a $D_{max}$ laydown of yellow toner. A particular printer with particular marking materials and a particular calibration deposits a certain mass laydown of toner for $D_{max}$ (100%) yellow. A non-yellow region is an area of the image in which the image data specify a yellow toner mass laydown at each engine pixel that is at most 10% of the yellow toner mass laydown corresponding to a yellow $D_{max}$ at that engine pixel. Since the relationship between percent coverage and mass laydown can be nonlinear, 10% mass laydown does not necessarily correspond to 10% coverage in image data 412.

In various aspects, to determine where a non-yellow region is in the image data, 10% mass laydown is converted to percent coverage using a calibration curve. The image data are then compared to the determined percent coverage to locate contiguous areas that have image data values at or below the determined percent coverage. This can be accomplished using a flood-fill algorithm using a comparison against the determined percent coverage as the boundary criterion. The non-yellow region can be discontinuous or include holes. For example, in a white image with a yellow square in the center of the image, the non-yellow region is the whole image, except for the area of the yellow square.

In various aspects, after fixing, the clear toner has a 100%-laydown height. The 100%-laydown height is approximately the mass laydown per unit area (MIA) divided by the toner mass density. The 100%-laydown height can be the maximum fused toner stack height $SFmax_t$, as described above. In some of these aspects, the height data specifies that the raised printing be higher than the 100%-laydown height of the clear toner.

Image data 412 also includes a mass laydown $M_A$, $M_B$ at each engine-pixel location for additional colored toners A, B (e.g., small-sized pigmented toners such as cyan and magenta) and a provisional mass laydown ($M_{Y,prov}$, corresponding to a fused toner stack height of $H_{Y,prov}$) at each engine-pixel location for the yellow toner (or other larger-sized pigmented toner). Instead of mass laydowns, image data 412 can include values (e.g., percent coverages) convertible to mass laydowns, as discussed above. Height data 414 include the fused toner stack height required ($H_{aim}$) at each engine-pixel location. In various aspects, step 410 includes receiving unfused-stack-height data and computing $H_{aim}$ values. The received unfused stack heights and parameters characterizing the toner material & fusing process are used to compute $H_{aim}$, as described in the above-referenced U.S. patent application Ser. No. 13/537,165. Image data 412 and height data 414 are provided to step 416, which includes steps 418, 420, 421, 423, 424, and 425.

In step 416, using a processor, separation data 429 are automatically determined for T, Y, A, and B toners. The Y toner contains yellow pigment. In an example, A is cyan and B is magenta. In another example, three additional toners are used: C, M, and K. Step 416 produces separation data 429, which includes the mass laydowns at each engine-pixel location for the Y, T, A, and B toners. Step 416 begins with step 418.

Step 418 determines the height $H_{ncl}$ of the toner stack produced by the non-clear toner laydown for each engine-pixel location, i.e., the mass laydown of A, B, and provisional Y together. This can be done using image data 412 and the relationship discussed above:

$$H_{ncl}=H_{Y,prov}+M2H_A(M_A)+M2H_B(M_B)$$

If image data 412 are not expressed in mass laydown ($M_x$), they can be converted to mass laydown as discussed above before the computation of $H_{ncl}$. Step 418 is followed by decision step 420.

In step 420 a raised height $H_{extra}$ is computed as $H_{aim}$ (height data 414) minus $H_{ncl}$ (from step 418) at each engine-pixel location. $H_{extra}$ is the amount of height to be added to the printed output corresponding to image data 412 to meet the requirements of the print job. For example, a magnetic-stripe card is generally printed with a background image and raised digits. Image data 412 specify the background image and height data 414 specify that the numbers be raised printing. In this example, $H_{extra}$ will be zero outside the numbers, where only the background image is to be printed. $H_{extra}$ will have a positive value for those engine pixels that contribute to printing the raised numbers.

Step 420 is performed for each engine pixel. For each engine pixel, step 420 is followed by one of steps 421 or 423, depending on the sign of $H_{extra}$. If $H_{extra}<0$ (the non-clear stack is too tall), the next step is step 421. If $H_{extra}>0$ (the non-clear stack is not tall enough), the next step is step 423.

If $H_{extra}=0$ (the non-clear stack is just right), or $H_{extra}$ is within selected tolerances of zero, e.g., 0±2 μm or $0\pm(0.1\times SFmax_T)$, the separation data for the clear toner are set to 0% mass laydown; no extra height is needed. The mass-laydown data for the A and B toners are retrieved from image data 412. The yellow-toner provisional mass-laydown data $H_{Y,prov}$ from image data 412 are retrieved. These data are together provided as separation data 429 to step 430.

If $H_{extra}\neq 0$, the image data are adjusted to change deposited amounts of the yellow or clear toners. A "deposited amount" of a toner is the mass laydown of that toner to be deposited (in Step 430) at a given engine-pixel location. Separation data 429 specify deposited amounts of toner. Deposited amounts can also be referred to as "deposition amounts," engine-pixel levels, or "deposition aims."

If $H_{extra}<0$, the Y, A, and B toners together produce a stack that is too high. Step 421 computes a reduced yellow toner height ($H_{Y,dim}$) that will bring the post-fusing toner stack height closer to $H_{aim}$. The mass laydown of yellow toner is then $H2M_Y(H_{Y,dim})$. However, reducing yellow laydown can result in a loss of color fidelity. A trade-off between height correction and loss of color fidelity can be governed by requiring the reduced yellow mass laydown be at least a selected percentage of the provisional yellow-toner mass laydown (e.g., at least 40% thereof). In various aspects, $H_{y,dim}$ is computed as:

$$H_{Y,dim}=\max(H_{Y,prov}\times\alpha, H_{Y,prov}-|H_{extra}|)$$

for a limit parameter α, e.g., 0.9. α can be between 0 and 1, inclusive. A value of a can be set for a given printing machine before shipping that machine to a customer, or can be received from a machine operator. Higher values of α correspond to higher color fidelity but more significantly over-height stacks.

In other aspects, LUTs or analytical curves are used to permit more precise control of the selected value as a function of the provisional yellow mass laydown computed in step 418. In various aspects, CIELAB values are computed for the color with the provisional yellow and with $H_{Y,dim}$, and $H_{Y,dim}$ is increased (or selected in the first place) so that the reproduced color is within a selected ΔE* distance of the color with the provisional yellow. The ΔE* threshold can be <=1.0 or <=2.0, or another value; larger thresholds correspond to reduced color fidelity and increased potential height.

However computed, step 421 provides $H2M_Y(H_{Y,dim})$ as yellow separation data, and A and B data from image data 412 are provided with it to compose separation data 429. Clear data in separation data 429 are set to 0%.

If $H_{extra}>0$, additional height is required. Decision step 423 computes whether the required $H_{extra}$ can be provided using clear toner. If so, i.e., $H_{extra}\leq SFmax_T$ (the maximum fused stack height of clear, i.e., "Transparent" toner, as discussed above), the next step is step 425. If not, the next step is step 424.

In step 424, separation data for the clear toner are produced calling for 100% mass laydown of clear toner (height of $SFmax_T$, as discussed above): $M_T=H2M_T(SFmax_T)$. There remains a stack height $H_{left}=H_{extra}-SFmax_T$ to be provided. An increased yellow toner height $H_{Y,crec}$ is computed based on the provisional yellow-toner mass laydown and on $H_{left}$, then separation data for Y are computed as $H2M_y(H_{Y,crec})$. As discussed above, changing the amount of yellow changes the color reproduced. In various aspects, $H_{y,crec}$ is computed as:

$$H_{Y,crec}=\min(H_{Y,prov}\times\beta, H_{Y,prov}+H_{left})$$

for threshold parameter β, which can be >1. That is, the full amount of height ($H_{left}$) is made up with yellow toner, unless that would increase $H_Y$ beyond the limit set by β. In various aspects, β=2−α. In various aspects, β can be received from an operator, as discussed above with reference to α. Lower values of β correspond to higher color fidelity but more significantly under-height stacks.

In other aspects, as discussed above, CIELAB deltas are computed to determine the amount by which $H_{Y,prov}$ can be increased without introducing more than the selected ΔE* error. However computed, step 424 provides $H2M_Y(H_{Y,crec})$ as yellow separation data, and $M_T$ computed above and A and B data from image data 412 are provided with it to compose separation data 429.

In step 425, the clear toner can provide the needed $H_{extra}$. Mass-laydown data $M_T$ for the clear toner is computed as $H2M_T(H_{extra})$, data for A and B are provided from image data 412, and data $M_Y$ for yellow are computed as $H2M_Y(H_{Y,prov})$. These together compose separation data 429.

Separation data 429 are provided to step 430.

In step 430, using an electrophotographic printer, respective developed toner images are deposited on the receiver using respective printing modules, each module and each developed toner image corresponding to respective separation data. The additional colored toners have respective volume-weighted median diameters between 3 μm and 12 μm. In various aspects, the electrophotographic printer has four, or at least five, electrophotographic printing modules. Step 430 is followed by step 440.

In step 440, the deposited toner is fixed to the receiver member using a fixing device. Fixing devices such as those described above with reference to FIG. 1 can be used.

Referring back to FIG. 2, in various aspects, control value 295 is received. Control value 295 can be α or β, as described above. More than one control value 295 can be received. These value(s) control the adjustment of yellow-toner amounts. Control value 295 can be received via interface 290, which can be a network or other connection to a computational or storage device that supplies control value 295. Interface 290 can also include a personal computer, human-machine interface (HMI), or other device for receiving control value 295 from an operator of the printer. Interface 290 can also include an HMI that receives from an operator a mapping (e.g., a LUT or an analytical curve) used by height unit 265 to control the color-height trade-off instead of the $\alpha$ and $\beta$ parameters. The LUT can map regions of the printer's gamut volume to the permissible change in colorimetry of colors in that region. For example, human observers are very sensitive to changes in sky and skin colors. These colors can therefore be coded in the LUT to have more accurate color reproduction, e.g., $\alpha$ and $\beta$ values relatively closer to 1.0, even at the expense of larger deviations from $H_{aim}$. Other colors, e.g., saturated magentas and greens, can be coded in the LUT to have more accurate height reproduction, e.g., $\alpha$ and $\beta$ values relatively farther from 1.0, even at the expense of larger calorimetric deviations.

Specifically, in various embodiments, step 416 (FIG. 4) includes receiving, via interface 290, a color-height tradeoff mapping. The color-height tradeoff mapping specifies, for each of a plurality of colors in the gamut volume of the electrophotographic printer, a respective color-height tradeoff parameter. The mapping can be indexed by RUB or CMY values, by CIELAB values, or by other colorimetric data, and can include data for individual colors or regions of the gamut, in any combination.

For each of a plurality of pixel locations for which image data and height data are provided, image data for the yellow toner are adjusted based on the height data and the color-height tradeoff parameter retrieved from the color-height tradeoff mapping for the corresponding image data. A first tradeoff value specifies better $H_{aim}$ matching; a second, different tradeoff value specifies better color matching. Here and throughout this disclosure, the color-height tradeoff value can be continuous (e.g., $\alpha$ and $\beta$) or discrete (e.g., height mode vs. color mode). Therefore, a difference between an actual laydown height at a selected pixel location and the height data for the selected pixel location has a lower magnitude for the first value of the retrieved color-height tradeoff parameter and a higher magnitude for the second, different value of the retrieved color-height tradeoff parameter. A colorimetric difference (e.g., $\Delta E^*$) between an actual color at the selected pixel location and the image data for the selected pixel location has a higher magnitude for a first value of the retrieved color-height tradeoff parameter and a lower magnitude for a second, different value of the retrieved color-height tradeoff parameter.

In various aspects of methods shown in FIG. 4, instead of yellow toner being used to add height, a light toner is used. The light toner having a first color is selected. The light toner has a volume-weighted median diameter ranging between 12 and 20 μm. Image data 412 includes a non-first-color region, and height data 414 specifies that raised printing should be produced in the non-first-color region.

A non-first-color region is defined with respect to a $D_{max}$ laydown of the light toner. A particular printer with particular marking materials and a particular calibration deposits a certain mass laydown of toner for $D_{max}$ (100%) of the light toner. A non-first-color region is an area of the image in which the image data specify a light toner mass laydown at each engine pixel that is at most 10% of the light toner mass laydown corresponding to a light-toner $D_{max}$ at that engine pixel. Since the relationship between percent coverage and mass laydown can be nonlinear, 10% mass laydown does not necessarily correspond to 10% coverage in image data 412. The light toner is denoted U herein.

In various aspects, toners A and B have relatively smaller-sized particles with relatively higher pigment loadings. Toner U has relatively larger-sized particles with relatively lower pigment loading. In an example, toner A is cyan, toner B is yellow, and toner U is magenta (effectively light magenta due to its larger size and lower pigment loading compared to cyan). In another example, toner A is magenta, toner B is yellow, and toner U is cyan (effectively, light cyan). In another example, toners A, B, and U are color primaries of a different color gamut than a CMY gamut. Toner A can be green, toner B can be blue, and toner U can be red.

In step 416, separation data are determined for the clear toner T, the light toner U, and at least two additional colored toners A and B. In various aspects, toner U has a covering power of 1.28 $cm^3/g$ and a smaller pigment loading than either toner A or toner B. The separation data for the light toner is determined in response to image data 412 and height data 414 so that the clear and light separations specify that respective toners be deposited one atop the other in the non-first-color region. Separation data can be produced as described above for T, Y, A, B separations (FIG. 4). In various aspects, K toner is used in addition to T, U, A, and B. Step 416 can also be used as described above. The values of $\alpha$ & $\beta$ used in step 416 can be different from those used for yellow due to different sensitivities in color gamut or granularity for a particular light color. These control values 295 (FIG. 2) can be used as described above.

Figure 5:
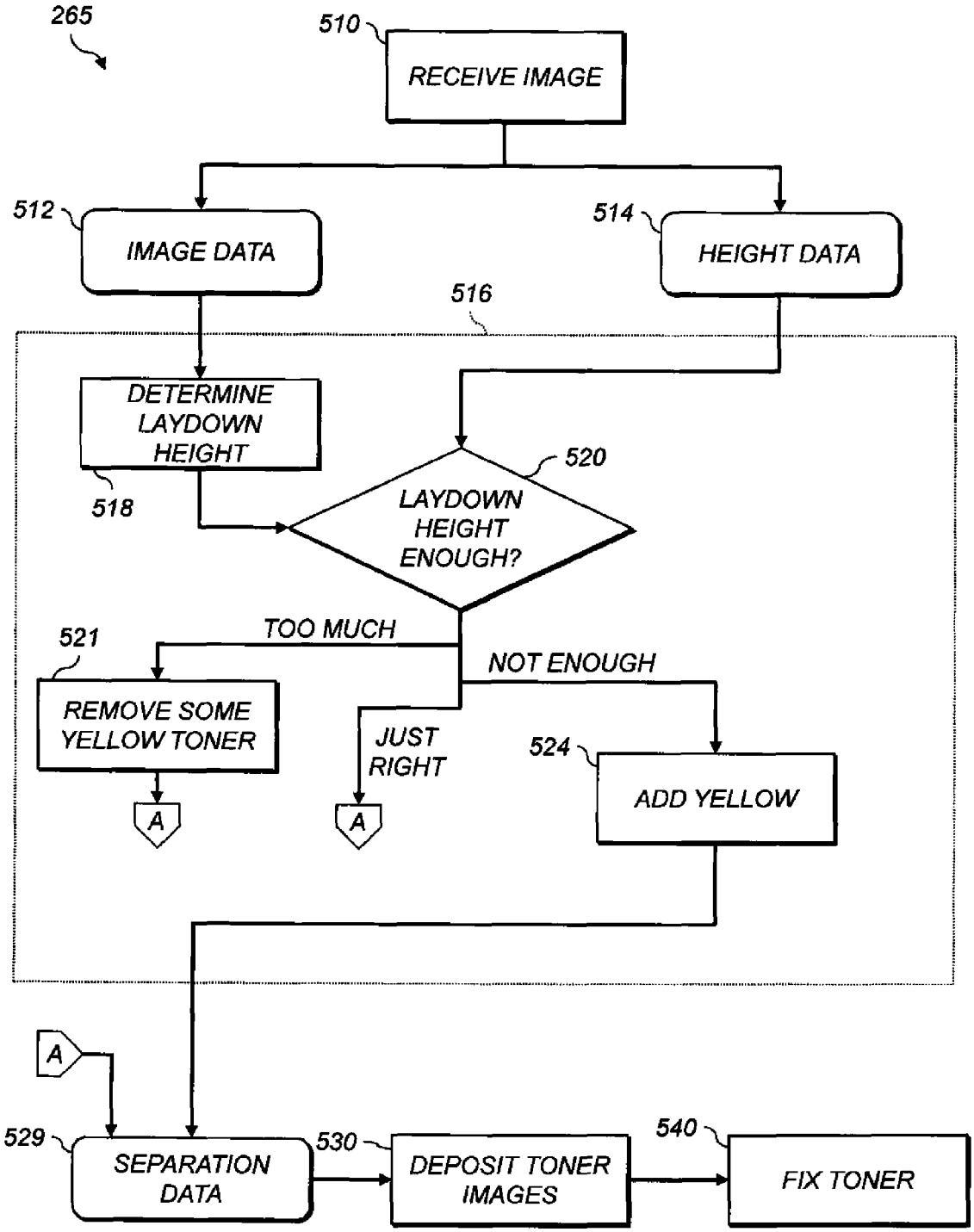

FIG. 5 shows ways of producing a raised print on a receiver using an electrophotographic printer including exactly three printing modules. These methods can be implemented in a processor, e.g., height unit 265 (FIG. 2). These methods use yellow toner to provide desired stack heights. Processing begins with step 510.

In step 510, image data 512 and height data 514 are received for an image to be printed. Data 512, 514 can be per-pixel or not, as discussed above with reference to step 410 (FIG. 4). Image data 512 include a non-yellow region, as defined above. Height data 514 specify that raised printing should be produced in the non-yellow region. Step 510 is followed by step 516.

In step 516, using a processor, separation data 529 for a yellow toner Y and two additional colored toners A, B are automatically determined. The separation data for the yellow toner is determined in response to image data 512 and height data 514 so that the yellow separation and at least one of the colored separations specify that respective toners be deposited one atop the other in the non-yellow region, as discussed above. Details of step 516 are discussed below. Step 516 produces separation data 529 that are provided to step 530.

In various aspects, the yellow toner has a volume-weighted median diameter ranging between 12 and 20 μm and the two additional colored toners have respective volume-weighted median diameters between 3 μm and 12 μm (pre-fusing). The two additional colored toners include respective amounts of black colorant. In various aspects, a black colorant is a colorant for which a printed monolayer of toner has an optical density of >1.0 and a C* of less than 5.

For example, the two additional colored toners can be a cyan toner and a magenta toner, and the cyan toner can includes a higher amount of black colorant than does the magenta toner. Using black colorant in these relative amounts permits providing a pleasing composite black (C+M+Y) without unduly reducing the printable gamut volume of cyancontaining colors. Printing pleasing composite black removes the need for a separate black channel, permitting the use of channels in the printer for raised printing. Not adding black colorant to the yellow, or adding very little black colorant to the yellow, advantageously permits using the yellow for raised printing rather than using a separate clear toner. This combination advantageously permits producing raised printing in a three-channel toner printer.

In an example, the following percentages of black pigment are used. The percentages are the ratio of black pigment to total pigment.

| | |
|---|---|
| Cyan | 1.5% black pigment |
| Magenta | 3% black pigment |
| Yellow | 0.5% black pigment |

These percentages can provide a reasonable color gamut, compared to CMY without black pigment added, and provide a denser composite black.

In step 530, using the electrophotographic printer including the exactly three printing modules, respective developed toner images are deposited on the receiver using the respective printing modules, each module and each developed toner image corresponding to respective separation data 529. Step 530 is followed by step 540.

In step 540, the deposited toner is fixed to the receiver member using a fixing device. In various aspects, after fixing, the clear toner has a 100%-laydown height and height data 514 specifies that the raised printing be higher than the 100%-laydown height of the clear toner. As discussed above, the pigment loading of a toner depends upon the particular pigment used, the toner size, and the desired covering power. In an example, for a covering power of 1600 $cm^2/g$ with 8 um toner, a 3.3% loading by weight of PY185 or a 10% loading by weight of PY155 can be used.

In various aspects, step 516 includes steps 518, 520, 521, and 524. Image data 512 are provided to step 518. Height data 514 are provided to decision step 520. Steps 518, 520, 521, and 524 are performed for each of a plurality of pixel locations for which image data 512 and height data 514 are provided.

In step 518, a toner laydown height of the yellow toner and the two additional toners is determined. This can be done as described above with reference to step 418 (FIG. 4), only adding up heights for toners Y, A, and B. Step 518 is followed by step 520.

In step 520, the determined toner laydown height is compared to the height data. In the following steps, image data 512 are adjusted based on the result of the comparison to determine separation data 529. If the determined non-yellow toner laydown height is substantially equal to the height data, however, the amounts of toner are left unchanged, as discussed above. Step 520 is followed by step 521, step 524, or step 530 (for each pixel location).

In step 521, if the determined toner laydown height is greater than the height data image data are adjusted to reduce the amount of yellow toner. This reduces the extent to which the height will be above what is desired. This can shift the color at the corresponding pixel location towards blue. In various aspects, the image data are adjusted to specify a mass laydown of yellow toner no less than a selected percentage a of a mass laydown corresponding to the received image data for the yellow toner. The selected percentage $\alpha$ can be received via an interface. Percentage $\alpha$, and the interface, can be as discussed above.

In step 524, the amount of yellow toner is increased up to a maximum stack height of yellow toner ($SFmax_Y$, as discussed above) to make the stack height match the height data if possible. This can shift the color at the pixel location towards yellow. In various aspects, the image data are adjusted to specify a mass laydown of yellow toner no more than a selected percentage $\beta$ of a mass laydown corresponding to the received image data for the yellow toner. Percentage $\beta$ can be received via an interface, as discussed above.

The invention is inclusive of combinations of the aspects described herein. References to "a particular aspect" and the like refer to features that are present in at least one aspect of the invention. Separate references to "an aspect" or "particular aspects" or the like do not necessarily refer to the same aspect or aspects; however, such aspects are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred aspects thereof, but it will be understood that variations, combinations, and modifications can be effected by a person of ordinary skill in the art within the spirit and scope of the invention.

PARTS LIST

21 charger
21*a* voltage source
22 exposure subsystem
23 toning station
23*a* voltage source
25 photoreceptor
25*a* voltage source
26 intermediate member
31, 32, 33, 34, 35, 36 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
200 input pixel levels
205 workflow inputs
210 image-processing path
220 output pixel levels
250 screening unit
260 screened pixel levels
265 height unit
270 print engine
290 interface
295 control value
310 data processing system
320 peripheral system
330 user interface system
340 data storage system

410 receive image step
412 image data
414 height data
416 determine separation data step
418 determine non-clear height step
420 non-clear height enough? decision step
421 remove yellow toner step
423 clear toner sufficiency decision step
424 add clear and yellow step
425 add clear step
429 separation data
430 deposit toner images step
440 fix toner step
510 receive image step
512 image data
514 height data
516 determine yellow-color requirement step
518 determine non-clear height step
520 non-clear height enough? decision step
521 remove yellow toner step
524 add yellow step
529 separation data
530 deposit toner images step
540 fix toner step

The invention claimed is:

1. A method for producing a raised print on a receiver using an electrophotographic printer including exactly three printing modules, the method comprising:

receiving image data and height data for an image to be printed, the image data including a non-yellow region and the height data specifying that raised printing should be produced in the non-yellow region;

using a processor, automatically determining separation data for a yellow toner and two additional colored toners, wherein the separation data for the yellow toner is determined in response to the image data and the height data so that the yellow separation and at least one of the two additional colored separations specify that respective toners be deposited one atop the other in the non-yellow region, wherein the yellow toner has a volume-weighted median diameter up to 30 μm and the two additional colored toners have respective volume-weighted median diameters between 3 μm and 12 μm, and the two additional colored toners include respective amounts of black colorant;

using the electrophotographic printer including the exactly three printing modules, depositing respective developed toner images on the receiver using the respective printing modules, each respective printing module and each respective developed toner image corresponding to respective separation data; and fixing the deposited toner images to the receiver using a fixing device.

2. The method according to claim 1, wherein, after fixing, the clear toner has a 100%-laydown height and the height data specifies that the raised printing be higher than the 100%-laydown height of the clear toner.

3. The method according to claim 1, wherein the two additional colored toners are a cyan toner and a magenta toner, and the cyan toner includes a higher amount of black colorant than does the magenta toner.

4. The method according to claim 1, wherein the determining step includes, for each of a plurality of pixel locations for which image data and height data are provided:

determining a toner laydown height of the yellow toner and the two additional toners;

comparing the determined laydown height to the height data;

adjusting the image data based on the result of the comparison to determine the separation data, the image data adjusted to:

if the determined laydown height is greater than the height data, reduce a deposited amount of yellow toner; or else if the determined toner laydown height is substantially equal to the height data, leave deposited amounts of toner unchanged; or else increase the deposited amount of yellow toner up to a maximum stack height of yellow toner to make the stack height match the height data, if possible.

5. The method according to claim 4, wherein the step of reducing the deposited amount of yellow toner includes adjusting the image data to specify a mass laydown of yellow toner no less than a selected percentage of a mass laydown corresponding to the received image data for the yellow toner.

6. The method according to claim 5, further including receiving the selected percentage via an interface.

7. The method according to claim 4, wherein the step of also increasing the deposited amount of yellow toner includes adjusting the image data to specify a mass laydown of yellow toner no more than a selected percentage of a mass laydown corresponding to the received image data for the yellow toner.

8. The method according to claim 7, further including receiving the selected percentage via an interface.

9. The method according to claim 1, wherein the determining step includes:

receiving, via an interface, a color-height tradeoff parameter; and for each of a plurality of pixel locations for which image data and height data are provided, adjusting image data for the yellow toner based on the height data and the color-height tradeoff parameter;

wherein a difference between an actual laydown height at a selected pixel location and the height data for the selected pixel location has a lower magnitude for a first value of the color-height tradeoff parameter and a higher magnitude for a second, different value of the color-height tradeoff parameter, and a colorimetric difference between an actual color at the selected pixel location and the image data for the selected pixel location has a higher magnitude for a first value of the color-height tradeoff parameter and a lower magnitude for a second, different value of the color-height tradeoff parameter.

10. The method according to claim 1, wherein the determining step includes:

receiving, via an interface, a color-height tradeoff mapping, wherein the color-height tradeoff mapping specifies, for each of a plurality of colors in the gamut volume of the electrophotographic printer, a respective color-height tradeoff parameter; and for each of a plurality of pixel locations for which image data and height data are provided, adjusting image data for the yellow toner based on the height data and the color-height tradeoff parameter retrieved from the color-height tradeoff mapping for the corresponding image data;

wherein a difference between an actual laydown height at a selected pixel location and the height data for the selected pixel location has a lower magnitude for a first value of the retrieved color-height tradeoff parameter and a higher magnitude for a second, different value of the retrieved color-height tradeoff parameter, and a colorimetric difference between an actual color at the selected pixel location and the image data for the selected pixel location has a higher magnitude for a first value of the retrieved color-height tradeoff parameter and a lower magnitude for a second, different value of the retrieved color-height tradeoff parameter.

* * * * *